United States Patent [19]

McCully

[11] Patent Number: 4,752,036

[45] Date of Patent: Jun. 21, 1988

[54] GRANULATOR

[75] Inventor: Mark A. McCully, Cleveland, Tenn.

[73] Assignee: Olin Research Center, Cheshire, Conn.

[21] Appl. No.: 440,396

[22] Filed: Nov. 9, 1982

[51] Int. Cl.[4] ..... B02C 13/13

[52] U.S. Cl. ..... 241/73; 241/226

[58] Field of Search ..... 241/73, 226, 186 A, 241/101.7

[56] References Cited

U.S. PATENT DOCUMENTS

| | | | |
|---|---|---|---|
| 2,669,396 | 2/1954 | Nickle | 241/89 |
| 2,816,716 | 12/1957 | Webb | 241/73 |
| 2,869,793 | 6/1959 | Montgomery | 241/50 |
| 3,829,030 | 8/1974 | Wallengang et al. | 241/89.1 |
| 4,114,817 | 9/1978 | Harris | 241/73 |
| 4,117,984 | 10/1978 | Waxelbaum et al. | 241/73 |
| 4,195,786 | 4/1980 | Walker | 241/101.7 |

*Primary Examiner*—P. W. Echols
*Assistant Examiner*—Joseph M. Gorski
*Attorney, Agent, or Firm*—Ralph D'Alessandro

[57] ABSTRACT

Helix apparatus fastened to the end flanges on a rotatable beater in a granulator for reducing the size of particles is provided to direct the granular particles from the opposing ends of the beater inwardly toward the central portion to reduce the amount of particles escaping through the opposing end walls of the granulator.

6 Claims, 2 Drawing Sheets

GRANULATOR

BACKGROUND OF THE INVENTION

This invention relates generally to granulation apparatus. More specifically, it pertains to apparatus present on the beater means to prevent the loss of the product to be granulated from the end walls of the granulator housing.

Granulators have been used for a number of years to reduce the size of particles. Generally, the particle reduction has taken place by forcing the particles through a screen with a plurality of holes of predetermined size and shape. The forcing of the particles through the holes can be done by either a hammer mill that has a rotatable shaft with radially extending hammers projecting therefrom or a rotatable shaft with radially projecting spaced blades mounted to the shaft. The rotatable shafts may be oriented either horizontally or vertically.

Most granulators that have been used to process chemical compounds wnich are formed in preformed flakes or moist rolls, such as calcium hypochlorite, utilize a generally horizontally extending rotatable shaft. In such a granulator, the granulated particles pass from the granulator into some type of a dryer where the particles are heated until the desired moisture level is obtained. The particles, however, once they pass through the granulator, are predetermined sized grains. What has not passed through the granulator screen is generally a fine particle that can be referred to as dust, or oversized particles needing further granulation. In prior granulators utilizing a generally horizontally extending rotatable shaft for calcium hypochlorite, these fine grains or dust particles tend to move outwardly on the beater means attached to the rotatable shaft and exit at the shaft junction in the end walls of the granulator housing. This results in considerable loss of chemical compound, as well as clogging between the end wall housing and the beater means flanges, and, because of the corrosive nature of the calcium hypochlorite, the possible accelerated corrosion of the granulator components at this critical location.

Attempts to seal this junction of the beater means flanges and the end walls have used ring members and flanges to provide a sealing surface in conjunction with a separate sealing member and the flanges. However, this design creates frictional heating between the ring members and the flanges which promotes product decomposition and accelerates component corrosion. To reduce the heat build-up, the sealing members have been removed , and the clearance between the ring members and flanges reduced. However, there is still some clearance through which the product particles will escape and eventually pass through the end walls of the granulator.

The foregoing problems are solved in the design of the present invention by providing a means to force the granular particles engaged by the beater means back to the central portion of the beater means away from the shaft ends mounted in the end walls of the housing.

SUMMARY OF THE INVENTION

It is an object of the present invention to provide on the opposing ends of the beater means apparatus to direct granular particles from the ends of the beater means inwardly towards the central portion of the beater means to reduce the amount of particles escaping through the end walls of the granulator housing.

It is another object of the present invention to provide means to reduce the amount of granular particles that build up at the junction of the beater means and the granulator end walls during operation.

It is a feature of the present invention that helix means are fastened to the arcuate periphery of the flange means on the first and opposing second ends of the beater means adjacent the end walls of the housing.

It is another feature of the present invention that the helix means fastened to the arcuate periphery of the flange means force the granular particles inwardly from the first end and opposing second end of the beater means toward the central portion of the beater means.

It is still another feature of the present invention that the helix means are continous ribs of arcuate peripheral configuration and predetermined height.

It is an advantage of the present invention that the amount of granular particles escaping through the opposing end walls of the housing is substantially reduced.

It is another advantage of the present invention that the helix means are simple in design and low on cost.

These and other objects, features and advantages are obtained by providing helix means with opposing helical patterns fastened to the arcuate periphery of the flange means so that during operation granular particles engaged by the beater means are directed from the first end and the opposing second end of the beater means inwardly toward the central portion of the beater means to reduce the amount of particles escaping through the opposing end walls.

BRIEF DESCRIPTION OF THE DRAWINGS

The objects, features and advantages of this invention will become apparent upon consideration of the following detailed disclosure of the invention, especially when it was taken into conjunction with the accompanying drawings wherein.

DETAILED DESCRIPTION OF THE PREFERRED EMBODIMENT

Figure 1:
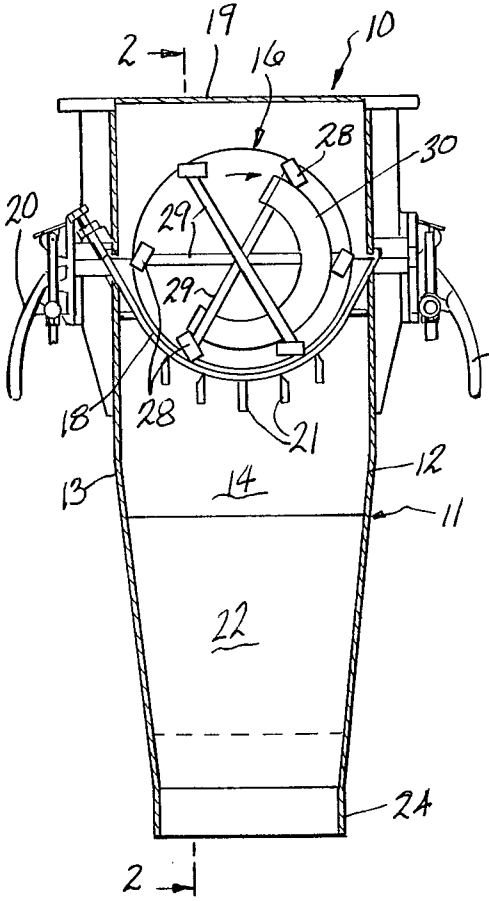
FIG. 1 is an end elevational view of a granulator.

FIG. 1 shows an end elevational view of the granulator, indicated generally by the Numeral 10. Granulator 10 has a housing, indicated generally by the Numeral 11, that has a front side 12, a rear side 13, and opposing end walls 14 and 15 (see FIG. 2). A beater means or assembly, indicated generally by the Numeral 16, is rotatably mounted in the end walls 14 and 15. The beater means or assembly 16 is mounted in the upper portion of the granulator 10 and overlies a removable screen 18, through which the particles to be granulated are forced by the beater means 16. The upper portion 19 of the granulator 10 may be removed by opening the pair of latch plates 20 which are found on the front side 12 and the rear side 13. Screen supports 21 underlie the screen 18. A pair of collection chutes 22 are mounted to the opposing end walls 14 and 15, seen best in FIG. 2. An outlet 24 at the base of the housing 11 receives the granulated particles as they pass enroute to the dryer (not shown).

Figure 2:
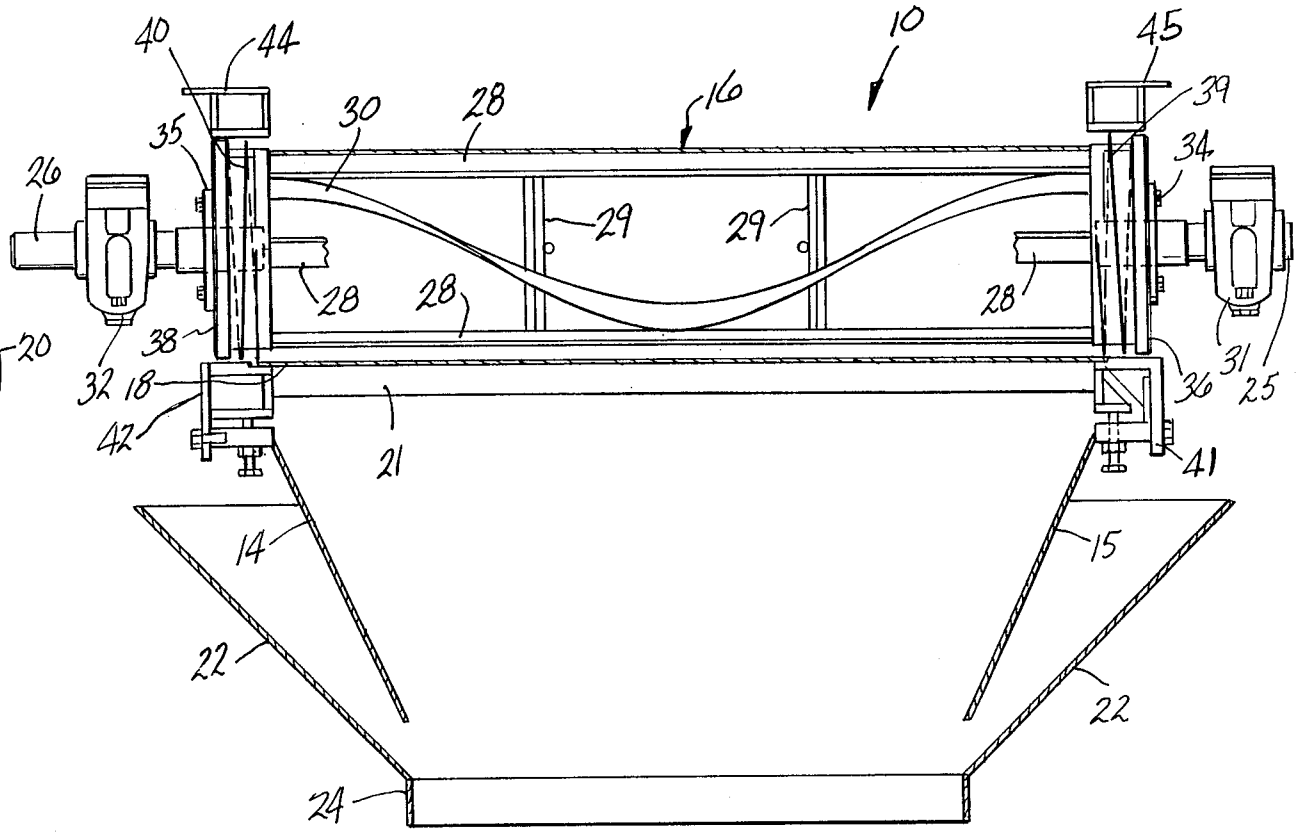
FIG. 2 is a sectional view taken along the lines 2—2 of FIG. 1 with the top portion of the housing removed.

As best seen in FIG. 2, the end walls 14 and 15 extend inwardly and downwardly toward the bottom of the housing 11, but end a predetermined distance above the junction of the outlet 24 and the collection chutes 22. The collection chutes 22 are thus seen to extend outwardly beyond the sides of the housing 11, underlying the stub shafts 25 and 26 of the beater means 16. Collection chutes 22 are naturally open-topped.

The granulator 10 has been described only generally thus far since its structures is old and generally well-known to one of skill in the art. A more detailed description of the granulator is found U.S. Pat. No. 4,117,984 to Waxelbaum et al., assigned to the assigness of the present invention and specifically incorporated by reference in pertinent part hereinafter in so far as it is consistent with the instant invention.

The beater means 16 is best shown mounted on housing 11 with the upper portion 19 of the granulator removed in FIG. 2. A plurality of beater bars 28, seen both in FIG. 1 and FIG. 2 are mounted to a plurality of support ribs 29. Beater bars 28 extend horizontally across the entire width of the interior of the granulator 10. The deflector 30 is helical in design and spans the entire horizontal length of the beater means 16. The deflector 30 is provided to uniformly distribute the granular particles across the working area of the granulator 10 prior to the particles being forced through the screen 18.

Beater assembly 16 is rotatably mounted to the housing 11 by stub shafts 25 and 26. As seen in FIG. 2, bearings 31 and 32, respectively, have stub shafts 25 and 26 pass therethrough. Shafts 25 and 26 also pass through flanged sleeves 34 and 35, respectively. Flanged sleeves 34 and 35 are fastened by bolts to end flanges 36 and 38 of the beater means 16. The end flanges 36 and 38 have a left hand helix means 39 and a right hand helix means 40, respectively, mounted to their arcuate peripheries. Helix means 39 and 40 serve to convey particles to be granulated inwardly from the end walls toward the central portion of the beater means, acting as a pair of screw conveyors. Sealing flanges 41 and 42 serve to seal the lower-most portion of beater means 16 against the loss of material from the opposing end walls 14 and 15 of the housing 11. At the top, partially shown sealing members 44 and 45 form a portion of the upper portion 19 of the granulator 10 and serve to prevent the loss of granulated particles about the end flanges 36 and 38 as the beater means 16 is rotated.

Figure 3:
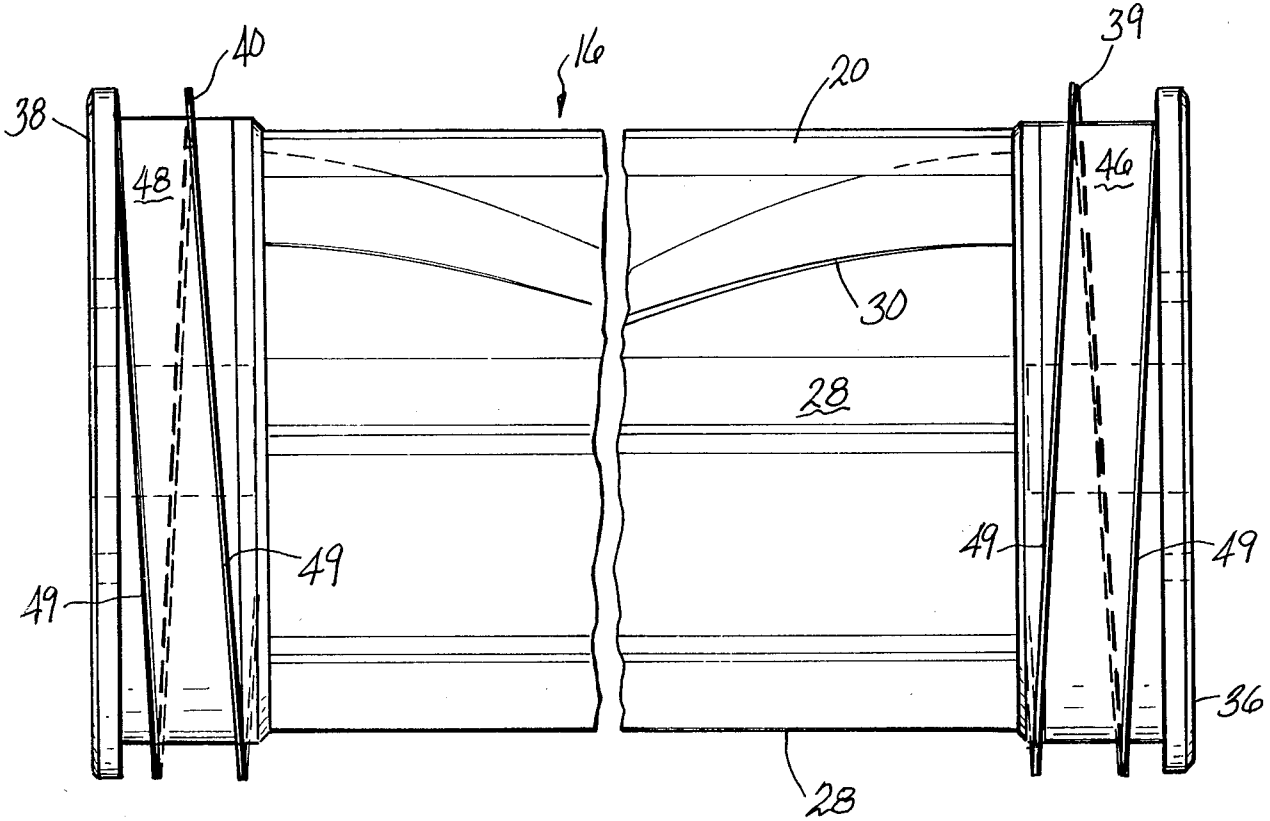
FIG. 3 is an enlarged side elevational view of the beater means of the granulator with the central portion broken away to show the opposing helical patterns of the helix means attached to the flange means.

FIG. 3 shows an enlarged fashioned beater means 16 with the central portion broken away. End flanges 36 and 38 have arcuate peripheries indicated by the Numerals 46 and 48, respectively. Helix means 39 and 40 are shown fastened to the peripheries 46 and 48 in oblique, intersecting relationship with the ends of the end flanges 36 and 38, and therefore, with the opposing end walls 14 and 15 of the granulator 10. Helix means 39 and 40 are seen to have a plurality of runs about the arcuate periphery that are obliquely oriented ribs 49. Ribs 49 are positioned in parallel relationship with each other so that there is a plurality of runs of the obliquely oriented ribs 49 about at least a portion of the arcuate peripheries 46 and 48.

In operation, particles to be granulated are fed into the top portion 11 of the granulator 10. A drive motor (not shown) is operably connected to the rotatable beater means 16 and rotates the beater means 16 so that the beater bars 28 engage the product to be granulated and force it into contact with the screen 18. The holes (not shown) in the screen 18 form the product into granulated particles of predetermined and desired size. The non-granulated particles continue to be contacted by the beater bars 28 and brushed against the screen 18 until the desired granulation occurs. Particles that do not pass through the holes of the screen 18 and which tend to be forced outwardly towards the end flanges 36 and 38 of the beater means 16 come in contact with the left hand helix means 39 and the right hand helix means 40 on the arcuate peripheries 46 and 48. The left hand helix means 39, with its obliquely oriented ribs 49 and the right hand helix means 40 with its obliquely oriented ribs 49, engage the fine particles prior to their being forced outwardly against the end flanges 36 and 38, respectively. Helix means 39 and 40 act as screw conveyors to engage the granular particles and direct them from the end flanges 36 and 38 adjacent to the end walls 14 and 15 inwardly toward the central portion of the particles prevents the majority of the particles from escaping between the end flanges 36 and 38 and the sealing flanges 41 and 42. Any particles that may escape, however, fall downwardly into the underlying chutes 22 and are redirected into the outlet 24 of the granulator 10 so they may be passed into the dryer (not shown) for processing.

While the preferred structure in which the principles of the present invention have been incorporated is shown and described above it is to be understood that the invention is not to be limited to the particular details thus presented, but in fact, widely different means may be employed in the practice of the broader aspects of this invention. The scope of the appended claims is intended to encompass all obvious changes in the details, materials and arrangement of parts which will occur to one of skill in the art upon a reading of the disclosure.

Having thus described the invention, what is claimed is:

1. A granulator for reducing the size of particles to a predetermined size having a housing with opposing end walls, an infeed to the housing, beater means rotatively mounted about shaft means to the housing having a central portion intermediate a first end and an opposing second end for engaging the particles, screen means having openings of a predetermined size and shape for reducing the particles to the predetermined size by having the beater means force the particles through the openings, flange means having an arcuate periphery rotatively fastened to the first end and the opposing second end of the beater means adjacent the opposing end walls, and an outlet adjacent to the screen means to receive the granulated particles, the improvement comprising:

helix means of an arcuate peripheral configuration fastened to the arcuate periphery of the flange means in opposing helical patterns and comprising continuous ribs fastened to the periphery of the flange means in oblique, intersecting relationship with the opposing end walls so that during operation granular particles engaged by the beater means and contacting the rotating helix means are directed from the first end and the opposing second end inwardly toward the central portion to reduce the particles escaping through the opposing end walls.

2. The apparatus according to claim 1 wherein there are a plurality of runs of the obliquely oriented ribs in parallel relationship with each other about at least a portion of the periphery of the flange means 3. The apparatus according to claim 2 wherein the beater means further comprises a plurality of beater bars intermediate of the flange connected to the shaft means for rotation thereabout.

4. The apparatus according to claim 1 wherein the housing further comprises open-topped chute means mounted in the opposing end walls underlying the flange means and extending outwardly from the central portion the beater means beyond the opposing end walls.

5. The apparatus according to claim 4 wherein the chute means further comprise an opening connecting the open-topped chute means to the outlet of the granulator.

6. The apparatus according to claim 5 wherein the beater means is mounted generally horizontally in the granulator.

* * * * *

UNITED STATES PATENT AND TRADEMARK OFFICE

CERTIFICATE OF CORRECTION

PATENT NO. : 4,752,036

DATED : June 21, 1988

INVENTOR(S) : Mark A. McCully

It is certified that error appears in the above—identified patent and that said Letters Patent is hereby corrected as shown below:

In column 5, at line 7 before "flange" and before "connected", insert --means--; and In column 6, at line 2 after "portion" and before "the", insert --of--.

Signed and Sealed this

Fourteenth Day of July, 1992

*Attest:*

DOUGLAS B. COMER

*Attesting Officer*

*Acting Commissioner of Patents and Trademarks*